United States Patent [19]

Weishar et al.

[11] Patent Number: 5,048,588

[45] Date of Patent: Sep. 17, 1991

[54] ROLL-UP DOOR CONSTRUCTION

[75] Inventors: William B. Weishar, Brookfield; Joe M. Delgado, Waukesha, both of Wis.

[73] Assignee: Kelley Company Inc., Milwaukee, Wis.

[21] Appl. No.: 371,264

[22] Filed: Jun. 26, 1989

[51] Int. Cl.[5] ..... E06B 9/56

[52] U.S. Cl. ..... 160/265; 160/310

[58] Field of Search ..... 160/310, 265, 322, 201, 160/133, 7, 8, 1, 188; 49/27, 28

[56] References Cited

U.S. PATENT DOCUMENTS

| | | | |
|---|---|---|---|
| 490,448 | 1/1893 | Lugrin | 160/322 X |
| 3,299,570 | 1/1967 | Radcliffe | 49/28 X |
| 3,460,602 | 8/1969 | Hugus | 160/265 |
| 3,462,885 | 8/1969 | Miller | 49/27 X |
| 3,582,998 | 6/1971 | Morse | 160/319 X |
| 3,878,879 | 4/1975 | Mann | 160/273 |
| 3,981,343 | 9/1976 | DeVito | 160/190 X |
| 4,133,365 | 1/1979 | Schleicher | 49/28 X |
| 4,373,602 | 2/1983 | Tomita et al. | 248/638 X |
| 4,452,292 | 6/1984 | Leivenson et al. | 160/133 |
| 4,570,437 | 2/1986 | Moritz | 248/49 X |
| 4,690,194 | 9/1987 | Seuster | 160/265 |
| 4,834,160 | 5/1989 | Becker | 160/265 X |

FOREIGN PATENT DOCUMENTS

| | | | |
|---|---|---|---|
| 2556403 | 6/1985 | France | 160/265 |
| 1444017 | 7/1976 | United Kingdom | 160/310 |

*Primary Examiner*—Blair M. Johnson

*Attorney, Agent, or Firm*—Andrus, Sceales, Starke & Sawall

[57] ABSTRACT

A roll-up door for enclosing a doorway in a building. The door comprises a horizontal rotatable drum mounted above the doorway and a flexible door panel is wound on the drum. A pair of first pulleys are secured to opposite ends of the drum and one end of a flat belt is secured to each first pulley, while the opposite end of each belt is dead-ended on a fixed object. A counterbalancing weight is attached to the belt intermediate its ends and exerts a counterbalancing force to wind door panel on the drum. A pair of second pulleys are secured to opposite ends of the drum and located adjacent the first pulleys. One end of a second flat belt is secured to each second pulley, while the opposite end of each second belt is connected to the lower end of the door panel. A drive member, such as a hydraulic motor, is operably connected to the drum and operation of the motor in one direction will unwind the door panel from the drum and move the door to a closed position, while operation of the motor in the opposite direction will wind the door panel on the drum to move the door panel to an open position. A resilient member of spring is connected to the second belt intermediate its ends and exerts a biasing force to stretch the door panel.

10 Claims, 4 Drawing Sheets

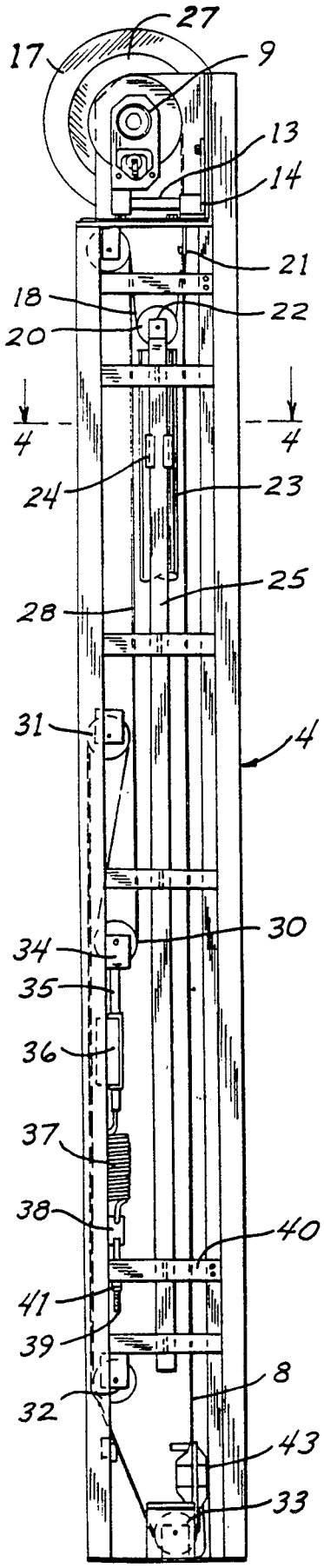
FIG. 2
FIG. 8
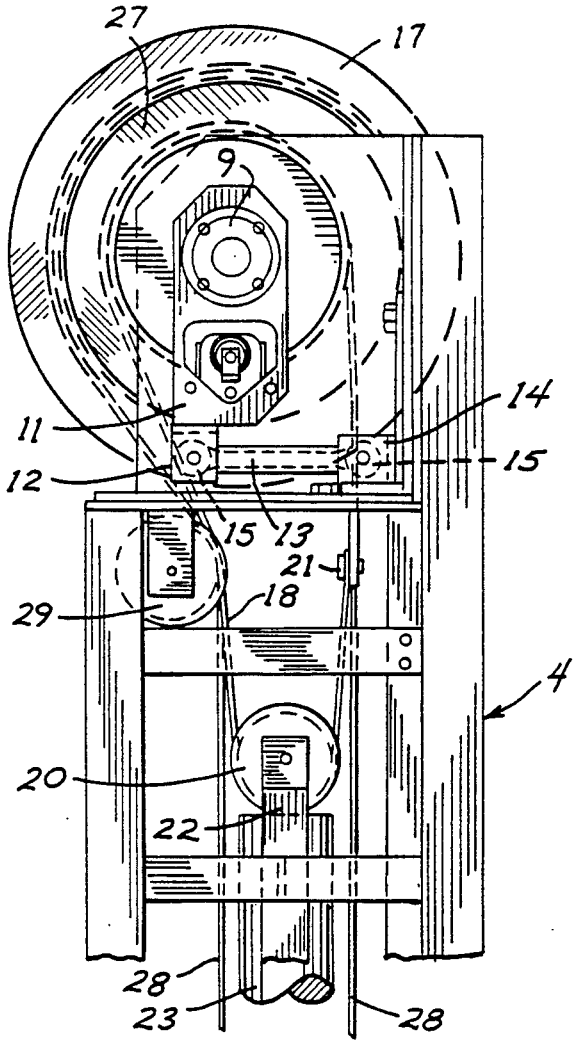

ROLL-UP DOOR CONSTRUCTION

BACKGROUND OF THE INVENTION

Roll-up doors are used in commercial or industrial establishments to separate different areas of a building, or to separate the inside of a building from the exterior. For example, roll-up doors may be used to separate two areas or zones which have different temperature or humidity conditions, or to provide noise control between two areas. A roll-up door has the advantage of being capable of being moved rapidly between the open and closed positions, and when in the open position, the door panel is wound on a drum located above the doorway, so that the door panel will not obstruct the doorway.

U.S. Pat. No. 3,878,879 describes a roll-up door, in which a roller is mounted above the doorway and a flexible door panel is wound on the roller. A winding drum is secured to each end of the roller and one end of a cable is secured to each winding drum. Each cable passes over a series of fixed pulleys and the opposite end of each cable is connected to the bottom of the door panel. To counterbalance the weight of the door panel, a weight is secured to each cable intermediate its ends.

In accordance with the construction of the aforementioned patent, trolleys are connected to the side edges of the door panel and ride in guideways on the frame as the door is wound and unwound on the roller, and the weight of the door panel is balanced by the proper selection of the diameter relation between the roller and the windup drum.

The roll-up door of U.S. Pat. No. 3,878,879 has certain disadvantages. If additional tensioning is required for the door panel when in the closed position to prevent wind deflection, it is necessary to add additional counterweight. However, added counterweight cannot be easily implemented and requires increased driving force to move the door panel to the closed position.

SUMMARY OF THE INVENTION

The invention is directed to an improved roll-up door for enclosing a doorway in an industrial or commercial building. The door includes a rotatable horizontal drum which is mounted above the doorway and is driven in a reversible manner by a drive unit, such as a hydraulic motor. A first pulley is secured to each end of the drum and one end of a flat belt is secured to each first pulley, while the opposite end of the belt is dead-ended on a fixed object. A counterbalancing mechanism, such as a counterweight, is attached to the belt intermediate its ends and exerts a rotational force on the drum in a direction to wind the door panel on the drum.

In addition, a second pulley is also secured to each end of the drum and is located adjacent a first pulley. One end of a second flat belt is secured to each second pulley, while the opposite end of the second belt is connected to the lower end of the door panel. A resilient member, such as a spring, is connected to each second belt intermediate its ends and is constructed and arranged to exert a force on the door panel to stretch the door panel at all positions. The force of the spring can be readily adjusted to regulate the tensioning of the door panel.

With the construction of the invention, the door panel tensioning system is separate from the counterbalancing system, so that the tension on the door panel can be controlled without affecting the counterbalancing system. Further, the tensioning spring acts to resist wind deflection of the door panel, when the panel is being unrolled or when it is in the fully unrolled condition.

As an added feature, the door construction of the invention includes an improved pressure sensing mechanism for reversing operation of the drive motor in the event the door panel strikes an object, as it is being unrolled. In this regard, a rigid hollow beam is secured to the lower edge of the door panel and a rubber bumper extends downwardly from the beam. The bumper is provided with a closed longitudinal passage that extends substantially the full length of the bumper and the passage contains a gas, such as air. A conduit connects the passage with a pressure switch, which is mounted within the rigid beam and the pressure switch is connected by electrical leads to a control box.

If the bumper strikes an object as the door panel is being unrolled, a pressure fluctuation is transmitted through the conduit to the pressure switch and the switch will then act to reverse operation of the motor to cause the door panel to be rolled on the drum. With this construction, the pressure switch is enclosed in the rigid beam and the electrical connections extend to the motor through the side frames of the door, so that neither the switch, nor the electrical leads, are in an exposed location where they could be contacted by material handling equipment.

Other objects and advantages will appear in the course of the following description.

DESCRIPTION OF THE DRAWINGS

The drawings illustrate the best mode presently contemplated of carrying out the invention.

In the drawings:

FIG. 2 is an end view of the door;

FIG. 8 is a fragmentary side elevation showing the drive mechanism.

DESCRIPTION OF THE ILLUSTRATED EMBODIMENT

Figure 1:
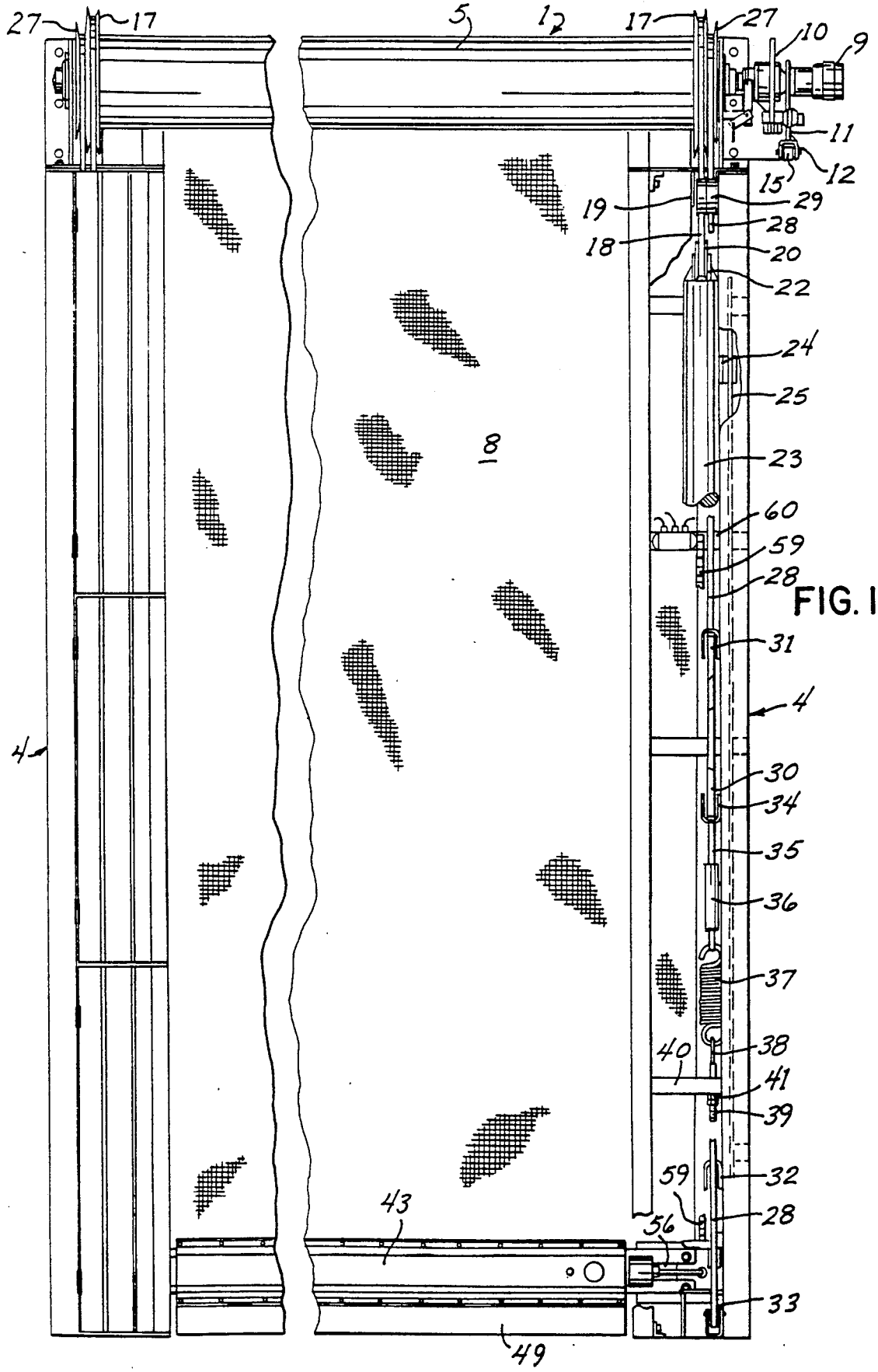
FIG. 1. is a front elevation of the door construction with parts broken away in section and showing the door panel in the closed or unrolled condition.

The drawings illustrate a roll-up door 1 which is adapted to enclose a doorway 2 in a commercial or industrial building 3.

Door 1 includes a pair of generally boxshaped vertical frame members 4 which are located along the sides of doorway 2. A cylindrical drum 5 is mounted horizontally above doorway 2 and a shaft 6 projects axially from each end of drum 5 and is journalled within bearings 7 that are mounted on the upper end of each frame member 4.

A flexible door panel 8 has one end secured to the outer surface of drum 5 and is adapted to be wound and unwound from the drum. In the unwound condition, panel 8 extends downwardly and will enclose the doorway 2, as shown in FIG. 1. Door panel 8 is preferably formed of fabric and is coated with a plastic material, such as polyvinylchloride, or the like.

To rotate drum 5, and thereby roll and unroll the door panel 8, a hydraulic motor 9 is connected to one end of shaft 6 through a disc brake mechanism 10. Operation of motor 9 in one direction will cause the panel 8 to unwind from drum 5, while rotation of the motor in the opposite direction will wind the panel on the drum. Brake 10 is constructed so that it will be in a disengaged condition when the motor is operating and will automatically be engaged when operation of the motor is terminated, so that the brake will then hold the door panel in any given position.

As a feature of the invention, the stopping and starting torque of motor 9 is absorbed by a mechanism that includes a plate 11 which is attached to motor 9 and the lower end 12 of the plate is bifurcated and is pivoted to one end of an arm 13. The opposite end of arm 13 is connected to a bracket 14 mounted on frame member 4. As shown in FIGS. 1 and 8, resilient bushings 15 surround the connections at the ends of arm 13. With this construction the starting and stopping torque will be absorbed by deflection of the resilient bushings 15. This construction eliminates shock loads, particularly on the reversal of the motor when the door panel may strike an obstruction as it is being unrolled to its closed condition.

Figure 3:
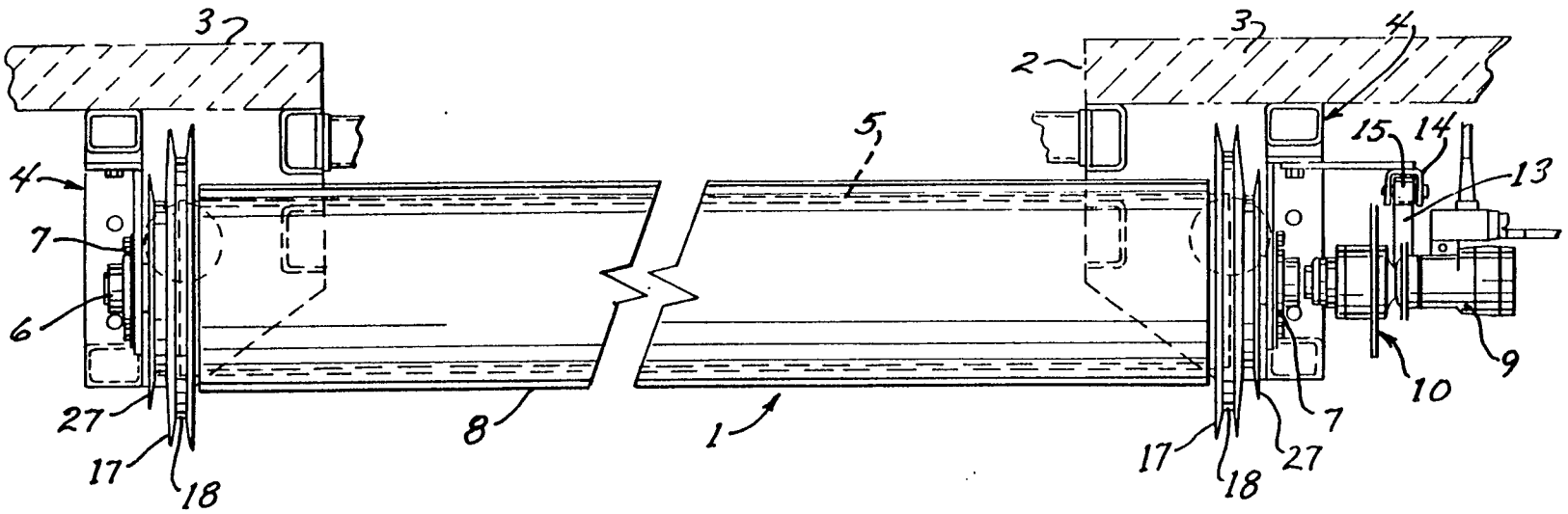
FIG. 3 is a top view of the door.

A pulley 17 is secured to each end of drum 5 and as shown in FIG. 3, the hub of each pulley 17 has a larger diameter than the outer diameter of drum 5. A generally flat belt 18 having a greater width than thickness is adapted to be wound in overlapping convolutions on each pulley 17. One end of each belt is secured to the pulley and the belt is then trained over a pulley 19, which is rotatably mounted on frame member 4 and then passes beneath a pulley 20 and is dead-ended on frame 4, as indicted at 21. Pulley 20 is mounted for rotation on a bifurcated bracket 22 and the lower end of the bracket 22 is connected to an elongated counterbalancing weight 23, which is housed within the respective frame member 4.

Figure 4:
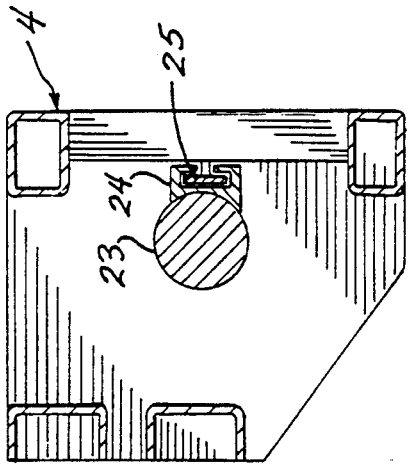
FIG. 4 is a section taken along line 4—4 of FIG. 2.

Weight 23 exerts a force tending to rotate pulley 17 and drum 5 in a direction to roll the door panel 8 on drum 5 and thus serves to counterbalance the weight of door panel 8. As door panel 8 is wound on drum 5, weight 23 will move downwardly within the frame member 4. To guide the counterweight in movement a guide block 24, preferably formed of plastic material, is secured to the outer surface of weight 23 and rides on a guide 25 secured to frame member 4, as best illustrated in FIG. 4.

In addition to the counterbalancing system, a separate tensioning system for door panel 8 is incorporated. In this regard, a pulley 27 is secured to each end of drum 5 and is located outwardly of the pulley 17. A generally flat belt or strap 28, is wound in overlapping convolutions on each pulley 27. One end of each belt 28 is secured to the pulley 27 and the belt then travels downwardly over pulley 29, which is mounted in side-by-side relation with pulley 19, then passes downwardly around pulley 30, upwardly over pulley 31 and then downwardly around pulleys 32 and 33. The end of each belt 28 is attached to the lower edge of door panel 8 in a manner as will be hereinafter described.

Pulleys 31, 32 and 33 are mounted for rotation through suitable brackets to the respective frame members 4 and are fixed in position relative to the frame member. Pulley 30 is mounted for rotation on a bifurcated bracket 34 and a rod 35 is secured to bracket 34 and extends downwardly in sliding relation through a sleeve 36 that is attached to frame member 4. As shown in FIGS. 1 and 2, the lower end of each rod 35 is connected to the upper end of an extension spring 37, while the lower end of each spring is connected via a bracket 38 to the upper end of a threaded rod 39 that extends through an opening in cross member 40. Adjusting nuts 41 are threaded on the lower end of each rod 39. With this arrangement, belts 28 exert a downward force on the door panel 8 when it is in the unrolled condition to stretch the door panel and resist wind deflection. By adjustment of nuts 41 on rods 38, the force of springs 37 can be varied to thereby control the tensioning force.

Figure 5:
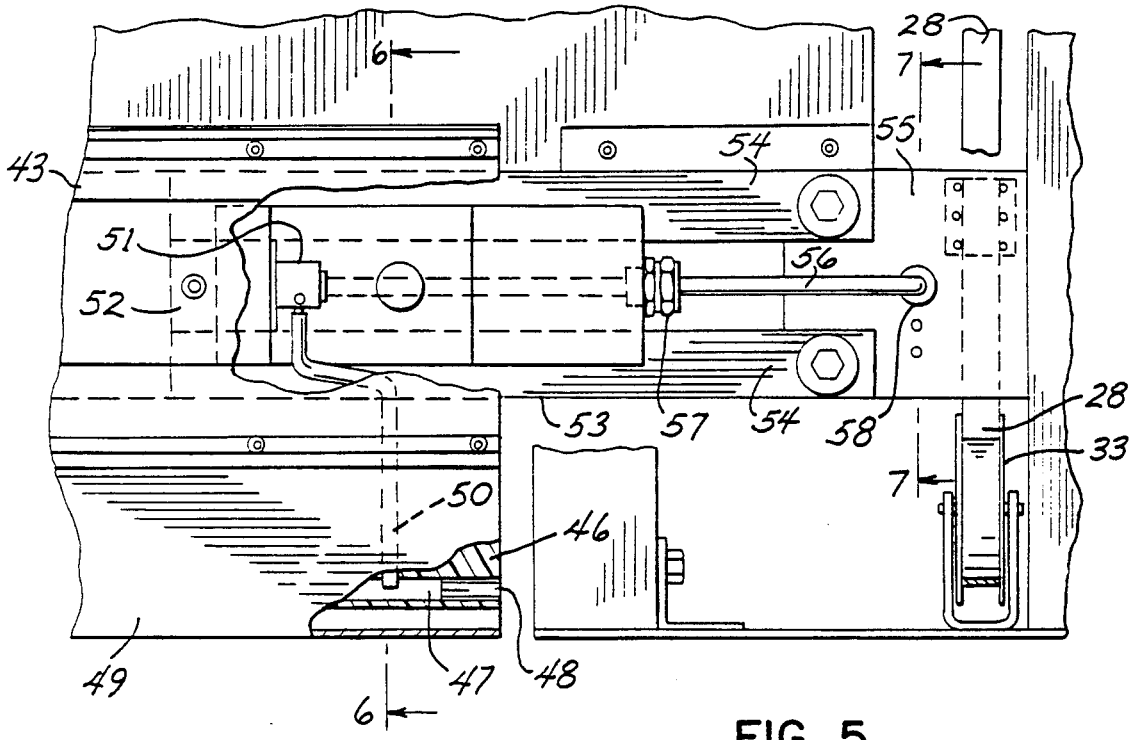
FIG. 5 is an enlarged fragmentary front elevation of the lower edge of the doors with parts broken away in section.
Figure 6:
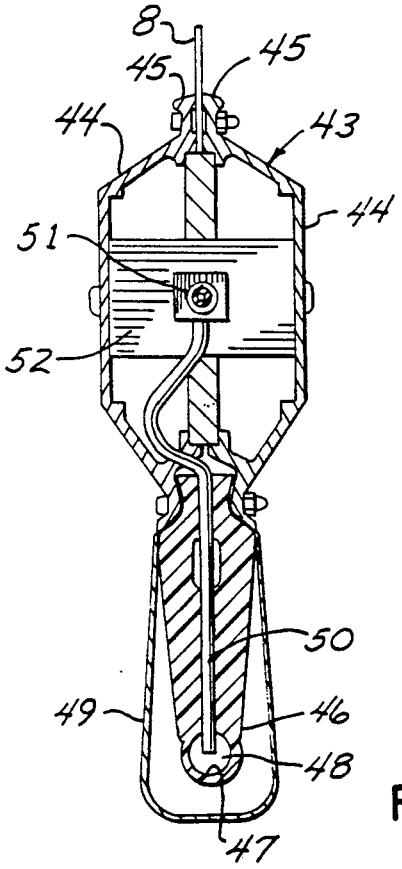
FIG. 6. is a section taken along line 6—6 of FIG. 5.
Figure 7:
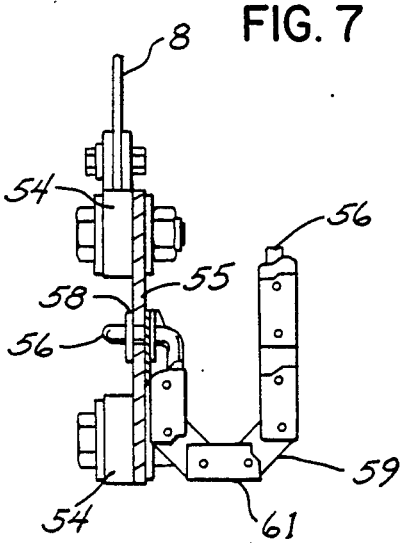
FIG. 7 is an end view taken along line 7—7 of FIG. 5.

A rigid hollow beam 43, preferably formed of a metal such as aluminum, is secured to the lower edge of door panel 8, as best shown in FIGS. 5–7. Beam 43 is formed of two halves 44 and the lower edge of door panel 8 is secured between the mating upwardly extending flanges 45 of halves 44, as shown in FIG. 6.

A resilient bumper 46, formed of a material such as rubber or plastic, is connected between the lower ends of halves 44 and extends downwardly from beam 43. The lower extremity of bumper 46 is provided with a longitudinal passage 47 which extends substantially the full length of bumper 46 and the ends of passage 47 are enclosed by plugs 48, so that the passage is closed to the atmosphere. As shown in FIG. 6, a fabric covering 49 can be positioned around bumper 46 and the ends of the cover are secured to beam 43.

Bumper 46 is preferably a dual Durometer structure, with the bottom portion of the bumper, which defines passage 47, being softer and having a lower Durometer than the upper portion.

A conduit 50 connects the interior of passage 47 with a conventional pressure switch 51, which is mounted on block 52 located within beam 43. A weldment 53 formed of a metal, such as steel, is secured within each end of beam 43 and projects outwardly therefrom. Each weldment 53 includes a pair of vertically spaced arms 54 and an end plate 55 is secured to the outer extremities of each pair of arms 54. As shown in FIGS. 5 and 2, the end of belt 28 is secured to the upper portion of end plate 55.

Electrical leads 56 connect pressure switch 51 with motor 9. As shown in FIG. 5, the leads extend through a fitting 57 in weldment 53 and then pass through grommet 58 in end plate 55. Leads 56 then extend within an elongated segmental guide 59. One end of guide 59 is secured to end plate 55, while the opposite end of the guide is connected to a bracket 60 on frame member 4. The end of guide 59 located adjacent plate 55 is looped downwardly as indicated by 61 in FIG. 7. As door panel 8 is rolled and unrolled from drum 5, the guide 59 will guide the electrical leads 56 and prevent entanglement of the leads.

With the construction of the invention, the pressure switch 51 is contained within beam 43 and is not exposed in a location where it could be damaged. Further, the electrical leads 56 extend through the end of beam 43 into the interior of the frame members 4, so that the leads are not in an exposed location where they could possibly be contacted by material handling equipment moving through the open doorway.

In the invention the counterbalancing and tensioning systems are separated, so that it is possible to change the tensioning without adjusting or varying the counterbalancing system. This is a distinct advantage over prior systems where increased tensioning was only obtained by increasing the counterweight or counterbalancing mechanism.

As the belts 18 and 28 are wound in overlapping convolutions, a change in belt thickness can vary the counterbalancing and tensioning effects. Thus, through proper design of the diameters of pulleys 17 and 27, as well as the thickness of belts 18 and 28, a substantial variation in the counterbalancing and tensioning can be achieved for any given application.

We claim:

1. A roll-up door construction for enclosing a doorway in a building, comprising rotatable drum means mounted on the building above said doorway, a flexible door panel disposed to be wound on said drum means, drive means for rotating said drum means to thereby move said door panel between a rolled-up open position and an unrolled closed position, a first flexible member having one end secured to said drum means and having the opposite end secured to a fixed object, counterbalancing means attached to said first flexible member intermediate the ends thereof for exerting a rotational force on said drum means to urge said door panel to the open position, a second flexible member having one end secured to said drum means and the opposite end connected to the lower end of said door panel, resilient means connected to said second flexible member intermediate the ends thereof and constructed and arranged to exert a downward biasing force on said door panel when the door panel is in the closed position, said flexible members being flat belts and each belt is disposed to be wound on said drum means in overlapping convolutions, said first and second flexible members being constructed and arranged such that both said flexible members are wound on said drum means in a maximum number of convolutions when said door panel is in the unrolled closed position, said resilient means comprising a spring, and adjusting means for adjusting the force of said spring.

2. The construction of claim 1, and including a pair of said first flexible members each disposed at opposite ends of said drum means and straddling said door panel, said construction also including a pair of said second flexible members each disposed adjacent a first flexible member.

3. The construction of claim 1, wherein said counterbalancing means comprises a counterbalancing weight.

4. The construction of claim 1, wherein the thickness of each belt is greater than the thickness of said door panel.

5. The construction of claim 1, and including pressure sensing means connected to the lower portion of said door panel and operably connected to said drive means, said pressure sensing means being constructed and arranged to sense contact of said door panel with an obstruction and transmit a signal to said drive means to reverse operation of said drive means.

6. A roll-up door construction for enclosing a doorway in a building, comprising frame means secured to the building on opposite sides of said doorway, a rotatable drum mounted on the building above said doorway, a flexible door panel disposed to be wound on said drum reversible drive means for rotating said drum to roll and unroll said door panel on said drum and move said door panel between a rolled up open position and a rolled out closed position, a rigid hollow support member connected to the lower edge of said panel, a resilient tubular member connected to the lower edge of said support member and including a closed passage extending substantially the entire width of said door panel, pressure switch means disposed within said support member, electrical lead connecting means operably connecting said pressure switch means to said reversible drive means, said electrical lead connecting means extending outwardly from an end of said support member and extending through said frame means to said drive means, means disposed in said frame means for preventing entanglement of said electrical lead connecting means as the door panel is moved between the open and closed positions, and a conduit connecting the interior of said passage with said pressures with whereby contact of said tubular member with an obstruction as said door panel is being moved toward the closed position will generate a pressure fluctuation to actuate said pressure switch and thereby reverse operation of said drive means.

7. The construction of claim 6, wherein said passage is disposed at the lower extremity of said tubular member.

8. The construction of claim 7, wherein the portion of the tubular member defining said passage has a greater flexibility than the remaining portion of said tubular member.

9. The construction of claim 6, wherein said means for preventing entanglement of said electrical lead connecting means comprises a segmented guideway to contain said electrical leads and having a looped end adjacent said support member.

10. A roll-up door construction for enclosing a doorway in a building, comprising rotatable drum means mounted on the building above said doorway, a flexible door panel disposed to be wound on said drum means, drive means for rotating said drum means to thereby move said door panel between a rolled-up open position and an unrolled closed position, a first flexible member having one end secured to said drum means and having the opposite end secured to a fixed object, counterbalancing means attached to said first flexible member intermediate the ends thereof for exerting a rotational force on said drum means to urge said door panel to the open position, a second flexible member having one end secured to said drum means and the opposite end connected to the lower end of said door panel, resilient means connected to said second flexible member intermediate the ends thereof and constructed and arranged to exert a downward biasing force on said door panel when the door panel is in the closed position, said flexible members being flat belts and each belt is disposed to be wound on said drum means in overlapping convolutions, said first and second flexible members being constructed and arranged such that both said flexible members are wound on said drum means in a maximum number of convolutions when said door panel is in the unrolled closed position, said resilient means comprising a spring having one end operably connected to said second flexible member and the opposite end of said spring being connected t a link, and adjusting means for adjusting the force of said spring, said adjusting means comprising means for moving the link to extend and contact said spring.

* * * * *

UNITED STATES PATENT AND TRADEMARK OFFICE

CERTIFICATE OF CORRECTION

PATENT NO. : 5,048,588

DATED : September 17, 1991

INVENTOR(S) : WILLIAM B. WEISHAR ET AL

It is certified that error appears in the above-identified patent and that said Letters Patent is hereby corrected as shown below:

Col. 5, Line 62, CLAIM 6, After "drum", first occurrence, insert --,-- (comma); Col. 6, Line 15, CLAIM 6, Delete "pressures with" and substitute therefor --pressure switch--; Col. 6, Line 61, CLAIM 10, After "connected" delete "t" and substitute therefor --to--; Col. 6, Line 64, CLAIM 10, Delete "contact" and substitute therefor --contract--

Signed and Sealed this

Sixth Day of July, 1993

*Attest:*

Michael K. Kirk

MICHAEL K. KIRK

*Attesting Officer*

*Acting Commissioner of Patents and Trademarks*